United States Patent [19]

Bokelman et al.

[11] 4,355,648

[45] Oct. 26, 1982

[54] METHOD OF CURING TOBACCO

[75] Inventors: Gordon H. Bokelman, Boulder, Colo.; Dewitt J. Gooden, III, Barnwell, S.C.

[73] Assignee: Philip Morris, Incorporated, New York, N.Y.

[21] Appl. No.: 214,491

[22] Filed: Dec. 9, 1980

[51] Int. Cl.[3] ..... A24B 3/12; A24B 15/20; A24B 15/22; A24B 15/30

[52] U.S. Cl. ..... 131/290; 131/299; 131/309; 131/310; 131/307

[58] Field of Search ..... 131/290, 297, 299, 300–307, 131/309, 310

[56] References Cited

U.S. PATENT DOCUMENTS

| | | | |
|---|---|---|---|
| 382,084 | 5/1888 | Hardwick et al. | 131/299 |
| 1,113,902 | 10/1914 | Lawrence et al. | 131/121 |
| 1,543,245 | 6/1925 | Buensod | 131/121 |
| 1,545,811 | 7/1925 | Buensod | 131/121 |
| 1,568,316 | 1/1926 | Buensod | 131/121 |
| 1,847,162 | 3/1932 | Andrews | 131/309 |
| 1,926,036 | 9/1933 | Chesley | 131/299 |
| 2,343,345 | 3/1944 | Touton | 131/121 |
| 3,086,533 | 4/1963 | Touton | 131/121 |
| 3,225,456 | 12/1965 | Touton | 131/121 |
| 3,371,670 | 3/1968 | Camenisch | 131/299 |
| 3,472,237 | 10/1969 | Stephens | 131/121 |
| 3,690,328 | 9/1972 | Quarenghi | 131/300 |

OTHER PUBLICATIONS

Sisler, "Photobleaching of Tobacco Leaves", Tobacco Science XX, 32–36, (1976).

*Primary Examiner*—V. Millin

*Attorney, Agent, or Firm*—Arthur I. Palmer, Jr.; George E. Inskeep

[57] ABSTRACT

Harvested green tobacco is cured by photobleaching followed by thermal browning. Photobleaching is preferably effected after incubation in vapors of an organic liquid or steam.

11 Claims, No Drawings

METHOD OF CURING TOBACCO

BACKGROUND OF THE INVENTION (a) Field of the Invention

This invention relates to a method for artifically curing harvested green tobacco employing photobleaching.

(b) State of the Art

Curing and/or aging of green tobacco by suspending the leaves in darkness or otherwise disposing the leaves while controlling temperature and relative humidity of circulating air currents is disclosed in U.S. Pat. Nos. 1,113,902, 1,543,245, 1,545,811, 1,568,316, 2,343,345 and 3,086,553. Forced air flow through bundles of green leaves has also been suggested as a means to cure green tobacco in U.S. Pat. No. 3,225,456. Such conventional methods of curing tobacco, characteristically require several days and may entail substantial expenditures for fuel. Further such curing processes tend to be labor intensive.

It has now been discovered that green tobacco can be artificially cured by photobleaching and thermally browning the tobacco. In contrast to the majority of prior art curing methods, the present invention provides a means for eliminating the green color and green odor and taste of tobacco which is rapid and less labor and energy intensive. By means of the present curing method tobacco of varying maturities can be converted to a uniform color. Thus the necessity for individual pickings of leaves, as required in many conventional processes, is eliminated. Further, the present method permits curing of whole plants, which is particularly beneficial where mechanical harvesting machines are employed, as for example, with close grown tobacco.

SUMMARY OF THE INVENTION

In accordance with the invention mature green harvested tobacco is cured by photobleaching the tobacco and thermally browning the bleached tobacco.

DETAILED DESCRIPTION OF THE INVENTION

The present invention provides a means for removing the green color and taste of tobacco. This artificial curing method comprises photobleaching the tobacco to remove the color therefrom and thereafter thermally browning the tobacco for a period of time sufficient to produce an acceptable color.

The process of the invention has application to harvested green tobacco including burley and bright tobaccos. Tobaccos of varying maturities may be cured to a uniform brown color in accordance with the method of the invention. When treated according to the invention, the tobacco may be in fresh untreated form or may have been pressed to express juices therefrom and thereby reduce the content of alkaloids, nitrogen, reducing sugars or the like in the tobacco material. The pressed tobacco may optionally be allowed to dry prior to treatment according to the invention. Further the tobacco to be treated may be whole leaf or in pieces.

Means for effecting photobleaching of tobacco are taught in the art. Such conventional techniques may be employed in the practice of the present invention. Sunlight, incandescent and ultraviolet light are all suitable means for accomplishing photobleaching.

For purposes of the present invention, it is preferred to incubate the green tobacco in steam or vapor of a volatile organic material prior to exposure to the photobleaching means in order to expedite bleaching. For example, incubation in vapors of acetone or of a 2–8 carbon alcohol, such as n-octyl alcohol, can hasten the photobleaching operation. Exposure to steam at 100° C. for 3 minutes is a particularly preferred means for incubating the tobacco.

Means for accomplishing photobleaching, as well as incubation, of tobacco are described in Sisler, "Photobleaching of Tobacco Leaves", Tobacco Science XX, 32–36 (1976), the disclosures of which are incorporated herein by reference.

Photobleaching is preferably done such that the tobacco material becomes completely white. Pretreatment of tobacco with steam for 3 minutes followed by 12–14 hours of sunlight is an especially effective means to this end. With n-octyl alcohol or acetone treatments, incubation for 12–15 hours followed by 15 hours of sunlight may be required for complete photobleaching. Other light sources may require longer exposure periods.

Following the photobleaching operation, the bleached tobacco is thermally browned by suitable means. One means effective for this purpose is heating the bleached tobacco at greater than 100° C. in an oven, tower or other suitable heating chamber until the desired brown color develops. A preferred means for browning is heating at about 190° C. for at least 5 minutes. A brown color similar to that obtained by conventional curing methods may be attained in as little as 7 minutes at 190° C. However, at higher temperatures shorter periods of time may be employed, especially when a reducing atmosphere is employed. Under such latter conditions, the tobacco should be cooled upon exiting the oven or tower and coming in contact with air to prevent its igniting.

The process of the invention does not drastically alter the chemistry of the tobacco. Further a tobacco leaf treated in accordance with the curing process of the invention has a form and color similar to conventional flue-cured tobacco. When combined with pressing the green tobacco to express the protoplasmic juices, the method of the invention provides a means for controlling the chemistry of the tobacco by appropriate treatment of the expressed materials and reapplication of the materials to the tobacco while avoiding the need for homogenization or stemming. Homogenization and/or stemming can, of course, be employed in conjunction with the method of the invention if desired.

The following examples are illustrative of the invention:

EXAMPLE 1

Two inch square sections of greenhouse grown Coker 298 mature green leaf tobacco were placed in a plastic bag. Two inch square sections of the same type of tobacco were pressed in a Carver hydraulic press at 3000 psi and were also placed in the plastic bag.

The sections were steamed for 3 minutes and then placed under a fluorescent desk lamp for 6 hours. The sections were rewet and bleached a further 8 hours. Some slight browning occurred. Considerable photobleaching was observed in both the pressed and unpressed sections, with the pressed sections being especially bleached.

A pressed and an unpressed section of the octyl alcohol bleached tobacco were placed in an oven at 190° C. for 7 minutes. A brown color appeared.

EXAMPLE 2

Mature green, unpressed (low stalk) leaf section of Coker 411, greenhouse grown tobacco were placed in a plastic bag along with 2 sections of the same tobacco pressed at 3000 psi on a Carver hydraulic press. Approximately 1 ml of octyl alcohol was placed in an upright eyeglass in the center of the bag which was lying flat with 2 leaf sections on either side of the glass. An aluminum sheet was placed under the plastic bag to give optimum reflection of light. A 150 watt flood light giving approximately 3000 ft candles (33,000 lux) of incandescent light was placed approximately 20" above the leaf sections. This light was selected to maintain the surface temperature below 38° C. The light was measured by a "Lunar Pro" light meter.

In 2 hours the pressed sections exhibited some bleaching. Considerable moisture condensation occurred over the unpressed section of the bag. After 6 hours only a little green color remained. Upon continued bleaching for about 8 hours, the pressed section became completely white while the unpressed section became yellowish brown. The alcohol did not evaporate, but rather most remained in the eyeglass. Bleaching was continued for several days to observe the long range effects of photobleaching; nothing further happened.

The final pressed result was bleaching to almost transparent while the unpressed section was golden brown except for a few green spots.

After about 24 hours of light most of the photobleaching had taken place when the tobacco was incubated with octyl alcohol. Some period, possibly a period of 14–15 hours, of preincubation with the octyl alcohol might hasten the reaction as reported by Sisler, Tobacco Science XX: 32–36, 1976.

EXAMPLE 3

Pressed and unpressed tobacco materials as in Example 2 were sealed in a plastic bag for pre-incubation in the presence of acetone before photobleaching was begun. The light as in Example 2 was turned on after 18 hours of pre-incubation at which time the acetone had not completely evaporated. The temperature was maintained below 38° C. At the end of 6 hours the unpressed section was beginning to become brownish white and there was a slight bleaching of the pressed section. After 6–7 hours the acetone had evaporated from the glass plate and recondensed on the plastic bag.

The unpressed section was creamy white with some slight brownish areas the next day; the pressed section was bleached to a light green color. The following day the control section was very white with a tendency to brown in certain areas; the pressed section was bleached almost transparent with a slight green tinge.

After 24 hours the control section bleached completely white. Nearly 40 hours were necessary to photobleach the pressed section. The photobleaching may progress more rapidly if a uniform moisture level were maintained in the sections during the bleaching.

EXAMPLE 4

Pressed and unpressed control leaf sections of tobacco as described in Example 2 were suspended in pint jars by paper clips and allowed to hang free during a 3 minute steam treatment. The sections of untreated and steam treated were placed in a plastic bag and sealed shut to prevent excessively rapid drying. The plastic bag was then placed under the flood lamp as in Example 2 to photobleach.

After about 16 hours of photobleaching the steam treated sections were completely bleached white. The untreated pressed sections was about ½ bleached transparent, while the untreated unpressed section was somewhat yellowed but still mostly green.

After about 30 hours of photobleaching the pressed section of the untreated tobacco had bleached nearly transparent. There was little further change in the unpressed section of untreated tobacco. Further attempts to bleach the untreated unpressed section of tobacco had little effect except the green color nearly disappeared as normal yellowing developed.

EXAMPLE 5

Using Coker 411 bright tobacco, greenhouse grown, low stalk mature green leaf, both pressed and unpressed leaf, was exposed to UV light. A pressed and unpressed leaf section was suspended into the mid area of an ultraviolet cabinet between four, 15 watt GE 1528 bulbs in the short UV range (2200°–3000 A°) with a peak at 2600 A°, 260 nm. This compares with 400–800 nm for visible light. The light intensity was not measured. The experiment was run for 3 hours with nothing visible happening. The temperature was monitored and never got above 32° C. The tobacco did not bleach.

Using the same green tobacco source as above, steamed pressed and unpressed leaf sections were exposed to UV light as described above except a plastic bag was placed over the sample. After 3 hours there was some light photobleaching. After an additional 16 hours the leaf material did bleach. There was some difficulty with folding of the leaf and also with excessive drying of the material. The final color was off-white with the folded areas of the leaf maintaining some green color. The temperature was maintained at 32° C.

The UV photobleaching was found a bit cumbersome due to the requirement that the samples be suspended between the lights, and also there was difficulty in preventing the sample from drying out.

EXAMPLE 6

Cigarettes were handmade from shredded tobacco comprising green leaf bright tobacco which had been sunbleached after a steam treatment followed by browning effected by heating at 190° C. for 15 minutes. Compared to a control cigarette formed from flue-cured tobacco, the photobleached cigarette had a bland off-taste.

What is claimed is:

1. A method of artificially curing green tobacco which comprises:

(a) photobleaching harvested tobacco; and (b) thermally browning the photobleached tobacco.

2. The method of claim 1 wherein the tobacco is mature green tobacco.

3. A method of artificially curing mature green tobacco from which juices have been expressed by means of pressure which comprises:

(a) photobleaching harvested tobacco; and (b) thermally browning the photobleached tobacco.

4. The method of claim 1 wherein the thermal browning is effected at a temperature above 100° C.

5. The method of claim 1 wherein the thermal browning is effected in an oven at 190° C. for at least 5 minutes.

6. The method of claim 1 wherein the photobleaching is effected by means of sunlight.

7. The method of claim 1 wherein the photobleaching is effected by means of ultraviolet light.

8. The method of claim 1 wherein the photobleaching is effected by means of incandescent light.

9. A method of artificially curing mature green tobacco which comprises:

(a) pretreating with steam for about three minutes;

(b) photobleaching; and (c) thermally browning the photobleached tobacco.

10. A method of artificially curing mature green tobacco which comprises:

(a) pretreating by exposure to vapors of an alcohol having 2 to 8 carbons;

(b) photobleaching; and (c) thermally browning the photobleached tobacco.

11. A method of artificially curing mature green tobacco which comprises:

(a) pretreating by exposure to acetone vapor;

(b) photobleaching; and (c) thermally browning the photobleached tobacco.

* * * * *